United States Patent [19]

Jung

[11] Patent Number: 5,068,981

[45] Date of Patent: Dec. 3, 1991

[54] SELF-VENTILATING DEVICE FOR A SHOE INSOLE

[76] Inventor: In Soo Jung, 298-25 Buam-1-Dong, Pusanjin-Ku, Pusan, Rep. of Korea

[21] Appl. No.: 619,994

[22] Filed: Nov. 30, 1990

[30] Foreign Application Priority Data

Oct. 27, 1990 [KR] Rep. of Korea ..... 90-16401

[51] Int. Cl.[5] ..... A43B 7/06; A43B 13/20; A43B 21/30

[52] U.S. Cl. ..... 36/3 R; 36/3 B; 36/29; 36/35 B; 36/7.8; 36/38

[58] Field of Search ..... 36/3 R, 3 B, 139, 29, 36/35 B, 7.8, 38, 28, 27, 35 R

[56] References Cited

U.S. PATENT DOCUMENTS

| | | | |
|---|---|---|---|
| 337,146 | 3/1886 | Gluecksmann | 36/7.8 |
| 2,442,026 | 5/1948 | Thompson, Jr. | 36/3 R |
| 4,654,982 | 4/1987 | Lee | 36/3 B |
| 4,860,463 | 8/1989 | Pin | 36/3 R |

FOREIGN PATENT DOCUMENTS

| | | | |
|---|---|---|---|
| 350103 | 1/1990 | European Pat. Off. | 36/3 R |
| 640720 | 11/1935 | Fed. Rep. of Germany | 36/3 R |
| 89045 | 6/1937 | Sweden | 36/3 R |
| 1239844 | 7/1971 | United Kingdom | 36/3 B |

*Primary Examiner*—Paul T. Sewell
*Assistant Examiner*—M. D. Patterson
*Attorney, Agent, or Firm*—Birch, Stewart, Kolasch & Birch

[57] ABSTRACT

A self-ventilating device for a shoe insole, which includes a heel chamber body having a spring disposed therein, an inlet valve having a plurality of sole aperture for communicating with a plurality of channels in the sole portion of the shoe insole, and a pair of outlet valves disposed in both side walls thereof for communicating to the atmosphere, whereby when each step is taken by the shoe user, a moisture and odor waste quantity of air is forced from the channels in the sole portion through the inlet valve to the heel chamber body when the pair of outlet valves are closed and expelled through the pair of outlet valves to the atmosphere automatically when the inlet valve is closed.

2 Claims, 3 Drawing Sheets

SELF-VENTILATING DEVICE FOR A SHOE INSOLE

BACKGROUND OF THE INVENTION

1. Field of the Invention

The present invention relates to a self-ventilating device for an insole of a shoe and more particularly, an improved self-ventilating device built in the heel portion of an inner sole, which includes a heel chamber body having a plurality of sole apertures which communicates with a plurality of channels disposed in the sole portion of the inner sole and a pair of outlets disposed at both side walls of the heel chamber body through both side walls of the heel portion of the inner sole communicating to the atmosphere, whereby the interior of the shoe can be continuously ventilated as well as the shock being pressed to the heel portion of the shoe can be absorbed.

2. Description of the Prior Art

Presently known insoles for shoes comprises elastomeric and resilient pads which are made of soft materials such as a sponge or rubber and contain a plurality of hole in the sole and in the heel of the shoe in order to increase foot comfort. In such types of insoles, it is very difficult to remove moisture and the odor produced as a result of moisture which collects in the shoe due to foot sweating caused by poor shoe ventilation. Since most people use their shoes for long period of time, it is essential to properly maintain and ventilate the shoes in order to avoid foot diseases such as, for example, water-eczema. In order to avoid the above-mentioned problems, Korean utility model application Ser. No. 90-6,819, filed by the present inventor, discloses a ventilating device for a shoe insole. However, such self-ventilating device has a number of disadvantages such as, for example, it cannot be maintained to ventilate for a long period of time and a valve cover thereof can be easily separated from a body member thereof. Furthermore, it is very difficult to manufacture.

SUMMARY OF THE INVENTION

Accordingly, it is an object of the present invention to provide a shoe ventilation system which is effective in providing a circulation of air within the shoe while it is in use.

Another object of the present invention is to provide a self-ventilating device built in the heel portion of an inner sole of a shoe, which includes a heel chamber body having an inlet valve which communicates with a plurality of channels disposed in the sole portion of the insole of the shoe and a pair of outlet valves which communicates to the atmosphere, whereby the interior of the shoe can be continuously ventilated.

A further object of the present invention is to provide a self-ventilating device built in the heel portion of an insole of a shoe, which further includes a spring disposed in a heel chamber body for continuously maintaining the resilient effect and absorbing the shock being pressed to the heel portion of the shoe insole.

Still another object of the present invention is to provide a ventilation system for sport shoes, working shoes, boots, and the like for removing moisture and foot odor from the shoe while it is being worn thereby reducing the occurrence of foot disease.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a self-ventilating device for a shoe insole, which includes a heel chamber body having a spring disposed therein, an inlet valve having a plurality of sole aperture for communicating with a plurality of channels in the sole portion of the shoe insole, and a pair of outlet valves disposed in both side walls thereof for communicating to the atmosphere, whereby when each step is taken by the shoe user, a moisture and odor waste quantity of air is forced from the channels in the sole portion through the inlet valve to the heel chamber body when the pair of outlet valves are closed and expelled through the pair of outlet valves to the atmosphere automatically when the inlet valve is closed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 5(A) and 5(B) are cross-sectional views of the device according to the present invention in an air introducing position and in an air expelling position thereof, respectively.

DESCRIPTION OF THE PREFERRED EMBODIMENTS

Figure 1:
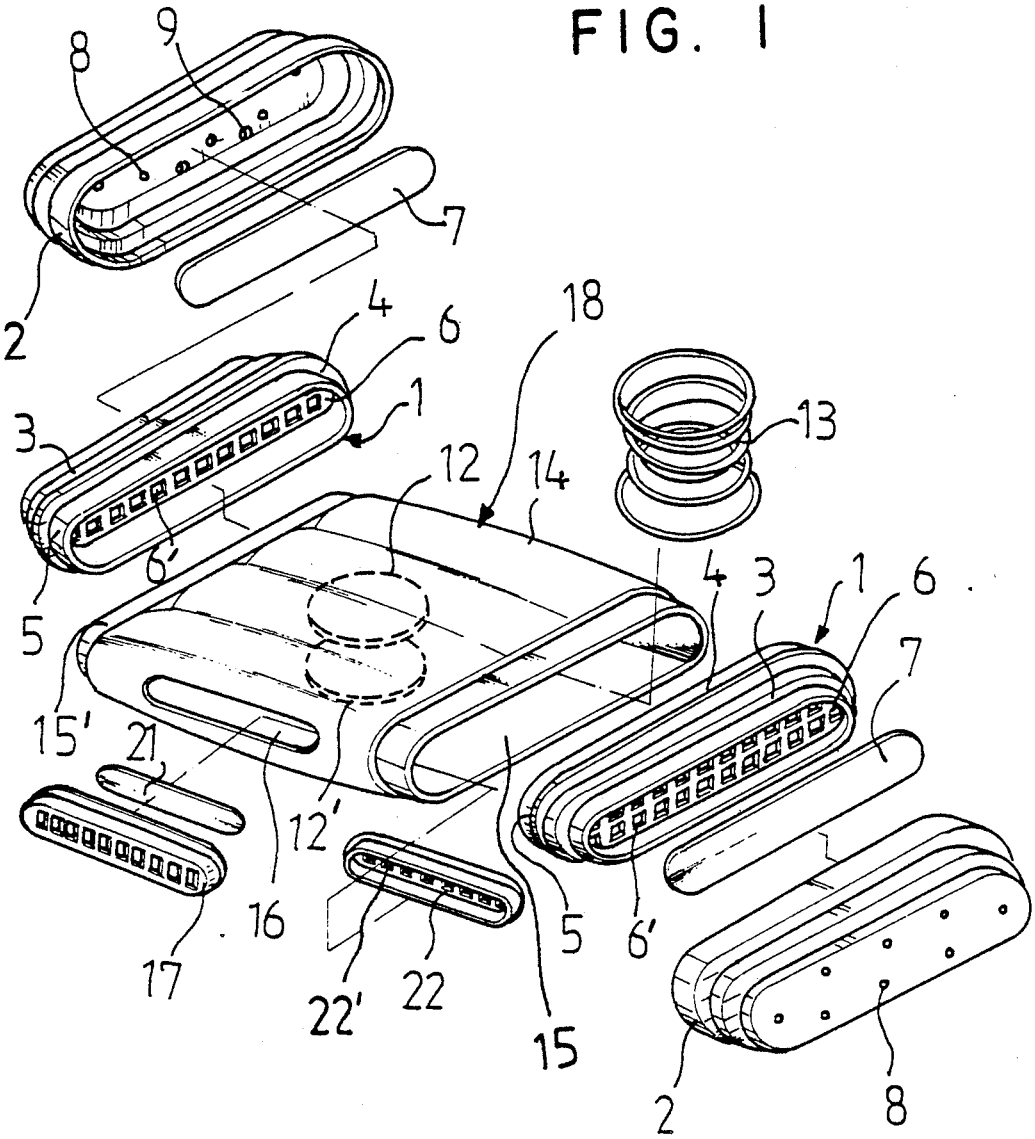
FIG. 1 is an exploded perspective view of the self-ventilating device according to the present invention.
Figure 2:
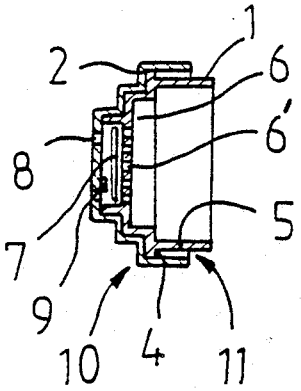
FIG. 2 is a sectional view of one outlet member of the device according to the present invention.
Figure 3:
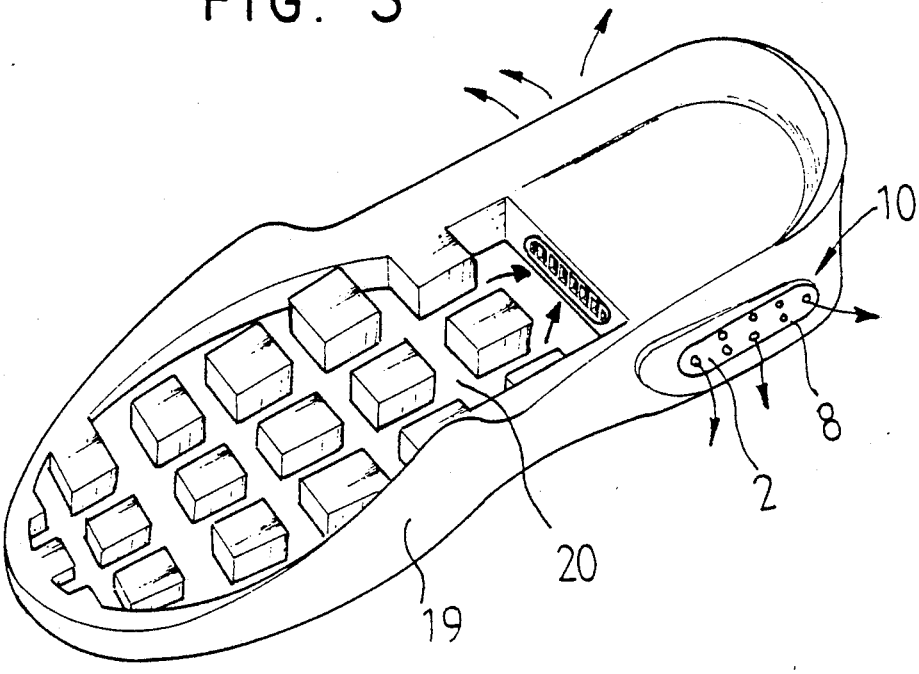
FIG. 3 is a perspective view of the self-ventilating device built in a shoe insole according to the present invention.
Figure 4A:
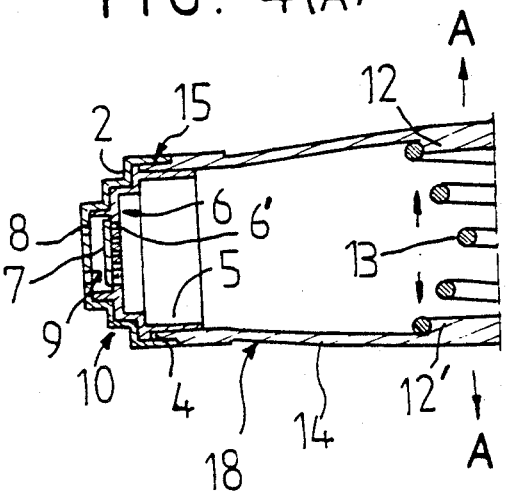
FIGS. 4(A) and 4(B) are sectional views of one outlet member of the device according to the present invention in a closed position and in a open position thereof, respectively.
Figure 4B:
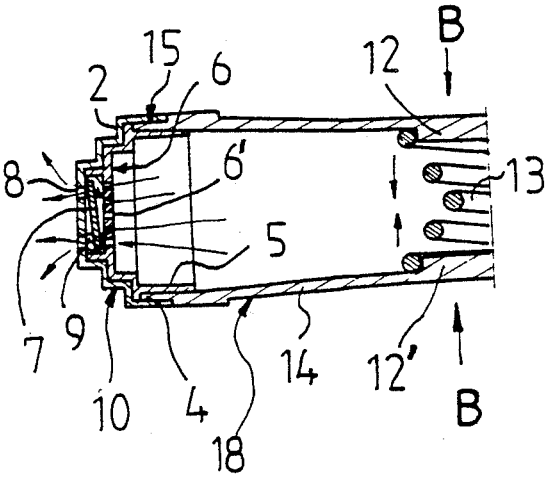
Figure 1:
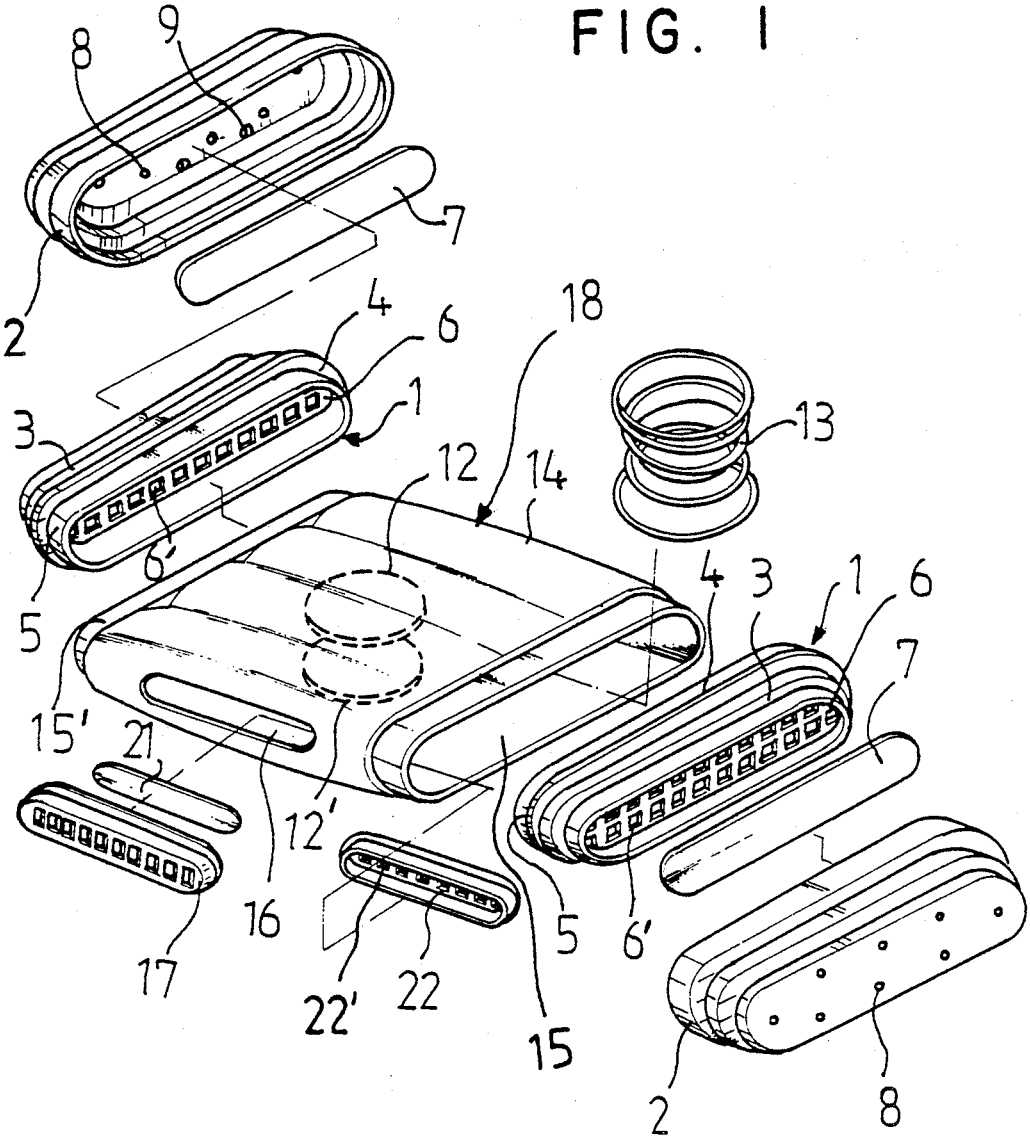
Figure 2:
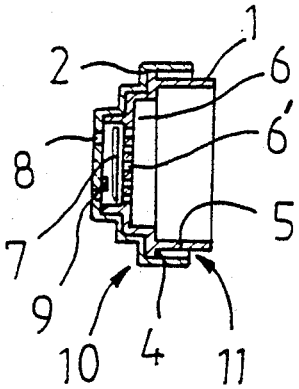

Referring now in detail to the drawings for the purpose of illustrating preferred embodiments of the present invention, the self-ventilating device for an insole of a shoe as shown in FIGS. 1, 2, and 3, comprises a cylindrical heel chamber body 14 including a spring 13, a pair of air outlet members 10 assembled with both ends 15 of the cylindrical heel chamber body 14, and an air inlet member 17 assembled with a hole 16 disposed at one side wall of the cylindrical heel chamber body 14. The self-ventilating device 18 is built in the heel portion of the insole 19 of the shoe, whereby the air inlet member 17 communicates with a plurality of channels 20 formed in the sole portion of the insole 19 and both air outlet members 10 communicates to the atmosphere through both side walls of the heel portion of the insole 19 (FIG. 3). The spring 13 disposed within a corresponding groove 12 which is disposed on the interior surface of a base and a cover of the cylindrical heel chamber body 14 for tightly receiving the spring 13. The spring 13 has preferably smaller size of the middle portion than both end portion thereof for maintaining its stability.

The air outlet member 10 includes an inner casing 1 assembled with an outer casing 2, and a movable outlet valve 7 disposed between the inner and outer casings 1 and 2. The inner casing 1 has a hollow configuration and a partition 6 containing a plurality of apertures 6'. Also, the inner casing 1 has a first circumferential raised portion 3 and a second circumferential raised portion 4 for tightly assembling with the outer casing 2 and a circumferential edge 15' of the cylindrical heel chamber body 14, respectively. The outer casing 2 has a plurality of outlet apertures 8 and at least two projects 9 for preventing the outlet valve 7 from closing to the outlet apertures 8 so as to only expel the waste air through the outlet apertures 8. As shown in FIG. 2, when the inner casing 1 is assembled with the outer casing 2, a circular space 11 is formed between them for slidably receiving the circumferential edge 15' of the cylindrical heel chamber body 14. At that time, the circumferential long edge 5 of the inner casing 1 is wider than the outer casing 2 for reducing any impact from the cylindrical heel chamber body 14.

As shown in FIGS. 5(A) and 5(B), the air inlet member 17 is assembled with an aperture plate 22 having a plurality of inlet apertures 8' through the hole 16. A movable inlet valve 21 is disposed between the inlet member 17 and the aperture plate 22. The aperture plate 22 has at least two projects 22' for preventing the inlet valve 21 from closing to the aperture plate 22 so as to induce only the waste air from the channels 20 in the sole portion of the insole 19.

As shown in the FIGS. 4(A), 4(B), 5(A), and 5(B), the self-ventilation device for a shoe insole according to the present invention operates as follows. When the wearer of the shoe places the heel thereof against the ground in taking a step, the device 18 of the heel portion of the insole 19 is compressed and the waste air delivered from the channels 20 is expelled to the atmosphere through the plurality of apertures 6' and the outlet apertures 8. At this time, the outlet valve 7 functions to open caused by the projects 9 when the waste air is being forced out of the cylindrical heel chamber body 14 and to close when the waste air has been replaced from the channels 20 through the inlet member 17. The inlet valve 21 opens only when the waste air in the cylindrical heel chamber body 14 is expelled to the atmosphere and a vacuum is created by the squeeze of the heel chamber body 14 as the foot is raised and the spring 13 is released. At that time, the outlet valve 7 is closed to the partition 6 so that the outlet valve 7 closes.

Thus, from the atmosphere the flow of the fresh air into the interior of the shoe with every step taken by the user functions to keep the foot dry and cool, thereby inhibiting the formation of foot fungi and other diseases since the self-ventilation device 18 functions to suction the waste air so as to expel to the atmosphere. The cylindrical heel chamber body 14 also provides a cushioning effect to the wearer which reduces the amount of body shock produced by walking through the spring 13 disposed therewithin.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A self-ventilating device built in the heel portion of an insole of a shoe, said self-ventilating device comprising:

a cylindrical heel chamber body having a spring disposed therein and being provided with a corresponding groove disposed in the interior surfaces of a base and a cover thereof for tightly receiving the spring, said spring having a small middle portion configuration, a pair of air outlet member assembled with both ends of said cylindrical heel chamber body, each of said outlet members including:

an inner casing having a plurality of apertures, said inner casing being provided with a first circumferential space disposed tightly receiving a circumferential edge of the cylindrical heel chamber body and having a wide, circumferential edge disposed in the outer side thereof, an outer casing assembled with said inner casing for forming a second circumferential space so as to avoid any impact from the cylindrical heel chamber body, said outer casing having a plurality of outlet apertures and at least two projects for preventing the outlet valve from closing thereto, and a movable outlet valve disposed between said inner and outer casings, and an air inlet member assembled with a hole disposed in one side wall of said cylindrical heel chamber body, said inlet member including:

a pair of outside and inside plates with a plurality of inlet aperture and a movable inlet valve disposed between said plates wherein at least two projects extending from said inside plate for preventing the inlet valve from closing thereto, whereby when pressure is applied to the heel chamber body, air is effectively expelled from the cylindrical heel chamber body through the air outlet members and when the pressure is released from the cylindrical heel chamber body, waste air is effectively drawn into the cylindrical heel chamber body through the air inlet member as well as simultaneously the shock being pressed to the portion of the shoe can be effectively absorbed.

2. The self-ventilating device of claim 1, wherein the inner casing contains a pair of circumferential raised portion for tightly assembling with the outer casing and the cylindrical heel chamber body.

* * * * *